United States Patent [19]

Yamamoto et al.

[11] Patent Number: 4,493,733

[45] Date of Patent: Jan. 15, 1985

[54] CORROSION-RESISTANT NON-MAGNETIC STEEL RETAINING RING FOR A GENERATOR

[75] Inventors: Masao Yamamoto, Tokyo; Takashi Yebisuya, Kawasaki; Mituo Kawai; Koichi Tajima, both of Yokohama, all of Japan

[73] Assignee: Tokyo Shibaura Denki Kabushiki Kaisha, Kawasaki, Japan

[21] Appl. No.: 536,236

[22] Filed: Sep. 28, 1983

Related U.S. Application Data

[63] Continuation of Ser. No. 359,245, Mar. 18, 1982, abandoned.

[30] Foreign Application Priority Data

Mar. 20, 1981 [JP] Japan ..... 56-39478
Mar. 20, 1981 [JP] Japan ..... 56-39481

[51] Int. Cl.[3] ..... C22C 38/58

[52] U.S. Cl. ..... 75/126 B; 75/126 J; 75/126 R

[58] Field of Search ..... 148/37, 137, 38; 75/126 B, 126 C, 126 Q, 126 R

[56] References Cited

U.S. PATENT DOCUMENTS

| | | | |
|---|---|---|---|
| 2,745,740 | 5/1956 | Jackson et al. | 75/126 B |
| 2,778,731 | 1/1957 | Carney | 75/126 B |
| 3,904,401 | 9/1975 | Mertz et al. | 75/126 B |
| 4,121,953 | 10/1978 | Hull | 148/38 |
| 4,394,169 | 7/1983 | Kaneko et al. | 75/126 B |

FOREIGN PATENT DOCUMENTS

| | | | |
|---|---|---|---|
| 3053513 | 5/1978 | Japan | 75/126 |

*Primary Examiner*—L. Dewayne Rutledge
*Assistant Examiner*—Debbie Yee
*Attorney, Agent, or Firm*—Schwartz, Jeffery, Schwaab, Mack, Blumenthal & Koch

[57] ABSTRACT

Disclosed is a corrosion-resistant non-magnetic steel comprising, in terms of weight percentage, 0.4% or less of carbon, above 0.3% but up to 1% of nitrogen, 2% of less of silicon, 12 to 20% of chromium, 13 to 25% of manganese and the balance consisting substantially of iron, the total content of the chromium and manganese being at least 30%.

6 Claims, 1 Drawing Figure

CORROSION-RESISTANT NON-MAGNETIC STEEL RETAINING RING FOR A GENERATOR

Figure 1:
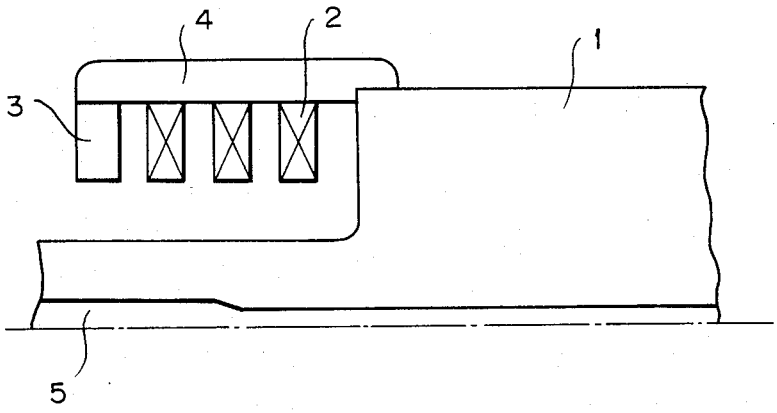

This application is a continuation of application Ser. No. 359,245, filed 3/18/82, now abandoned.

The present invention relates to a high manganese non-magnetic steel and a retaining ring for a generator made of it, specifically to a high manganese non-magnetic steel excellent in corrosion resistance and a retaining ring for a generator made of the steel.

High manganese non-magnetic steels are attractive as materials for constitution of various articles, since they are less expensive than Cr—Ni type non-magnetic steels and also excellent in abrasion resistance and work hardening characteristics. They are used mainly at the sites, where it is desired to avoid eddy current or not to disturb magnetic field such as a rotor binding wire of a turbine generator or an induction motor, a gyrocompass, an iron core tie stud, a non-magnetic electrode for a cathode ray tube, a crank shaft for a ship, etc.

A high manganese non-magnetic steel contains a large amount of carbon and manganese, which are principal constituent elements of austenite, with the intention of obtaining non-magnetic characteristics as well as strength. For the purpose of obtaining the non-magnetic characteristics, it is generally considered to be necessary to add 0.5% of carbon and 10 to 15% or more of manganese (Koji Kaneko et al., "Tetsu to hagane (iron and steel)", 95th Taikai Gaiyosyu (Meeting summary part), Nippon Tekko Kyokai (Japanese iron and steel institution), 1978, P332). Such increased contents of carbon and manganese, while improving the mechanical strength of the material, will lower markedly corrosion resistance thereof.

There has also been developed a high manganese nonmagnetic steel in which the content of chromium is enhanced in order to improve the corrosion resistance. Increase in the chromium content can reduce the contents of carbon and manganese necessary for obtaining non-magnetic characteristics. As the results, addition of chromium along with decrease in carbon and manganese contents can improve slightly corrosion resistance of a high manganese non-magnetic steel. At a higher level of chromium added, however, precipitation of carbide is increased, and hence no remarkable improvement of corrosion resistance, especially pitting corrosion resistance, stress corrosion cracking resistance (hereinafter referred to as SCC resistance), can be expected. In addition, a remarkable increase in chromium content results in formation of delta-ferrite which will reduce the characteristics as a non-magnetic steel. Thus, it is not effective for improvement of corrosion resistance of a high manganese non-magnetic steel containing a high level of carbon to increase the content of chromium.

On the other hand, as is generally known, an austenite type stainless steel (non-magnetic steel) is low in yield strength and no strengthening by heat treatment can be expected. For this reason, in a high manganese non-magnetic steel, improvement of mechanical strength has been attempted by addition of carbon and manganese in large amounts, but the yield strength attained is generally 50 kg/mm$^2$ or less. Accordingly, in a member such as a crank shaft for a ship which requires a high yield strength, the yield strength is enhanced for its utilization by way of a cold working. In recent years, there is a trend that higher mechanical strength is required for materials; and the percentage of employing a cold working is increased, concomitantly with extreme increase in SCC sensitivity of the materials. Further, due to expansion of the field in which high manganese non-magnetic steels are to be employed, crevice corrosion has not become the problem. That is, when a high manganese non-magnetic steel is in contact with a material nobler in corrosion potential such as an insulating material, it may suffer from crevice corrosion by the action of a corroding medium such as sea water. This is a great problem with respect to the reliability of the material.

In the light of the state of the art as described above, it is generally desired to develop a high manganese non-magnetic steel excellent in general corrosion resistance, pitting corrosion resistance, crevice corrosion resistance and SCC resistance.

A retaining ring for a generator which is one of the concrete applications of a non-magnetic steel will illustratively be explained as follows:

A retaining ring for a generator is a ring for keeping end turn of a rotor coil in place under a high speed rotation of a generator rotor, and a very high centrifugal force is loaded on the retaining ring at the time of the rotation. Therefore, an retaining ring is required to have a high yield strength enough to put up with such a high centrifugal force. If a retaining ring is a ferro magnetic metal, an eddy current is generated in the retaining ring to lower efficiency of power generation and therefore a retaining ring is required to be non-magnetic.

In the prior art, there has been used a 5% Cr-18% Mn type high manganese non-magnetic steel (austenite type stainless steel) as the retaining ring material. However, as is well known, an austenite type stainless steel is low in yield strength and no strengthening can be expected by heat treatment. Thus, retaining rings are used after their yield strength has been improved by cold working.

A high manganese non-magnetic steel contains a large amount of carbon and manganese with the intention of retaining non-magnetic characteristics, improving work hardening characteristics and preventing the formation of strain-induced martensite by a cold working. Such increased contents of carbon and manganese in these materials will lower markedly corrosion resistance thereof, especially pitting corrosion resistance. Further, with the increase in the ratio of cold worked materials, SCC sensitivity of the materials is increased. For example, while there has heretofore been developed a retaining ring of a class having a yield strength of 110 kg/mm$^2$, it is earnestly desired for a generator rotor with enlarged dimensions to be provided with a retaining ring of a class having a yield strength of 120 to 130 kg/mm$^2$. However, increase in yield strength will lead to increased cold working ratio, resulting in further increased sensitivity of SCC. Thus, it is now desired to develop a novel retaining ring for a generator which is excellent in SCC resistance and has a high strength.

There is also inserted an insulator between a retaining ring and a generator rotor, at which there may be caused generation of crevice corrosions through the action of a corrosive medium such as sea water fume or cooling water for a generator rotor. This is a great problem with respect to reliability of a retaining ring.

As described above, for a generator rotor with enlarged dimensions, it is desired to develop a retaining ring for a generator with high strength having also general corrosion resistance, pitting corrosion resistance, crevice corrosion resistance as well as SCC resistance.

An object of the present invention is to provide a high manganese non-magnetic steel excellent in general corrosion resistance, pitting corrosion resistance, crevice corrosion resistance and SCC resistance.

Another object of the present invention is to provide a non-magnetic retaining ring for generator with high strength which is excellent in general corrosion resistance, pitting corrosion resistance, crevice corrosion resistance and SCC resistance.

That is, the present invention provides a corrosion-resistant non-magnetic steel, excellent in general corrosion resistance, pitting corrosion resistance, crevice corrosion resistance and SCC resistance comprising, in terms of weight percentage, 0.4% or less of carbon, above 0.3% but up to 1% of nitrogen, 2% or less of silicon, 12 to 20% of chromium, 13 to 25% of manganese and the balance consisting substantially of iron, and the total content of the chromium and manganese is at least 30%, or further containing in said steel 5% or less of molybdenum.

The objects and features of the present invention will be more clearly understood from the following detailed description in reference to the accompanying drawings, in which:

FIG. 1 is a partial sectional view of a generator in the vicinity of a retaining ring which is one embodiment of the present invention.

In FIG. 1, reference numerals 1, 2, 3 and 4 represent, respectively, a rotor shaft, a coil turn, a supporting ring and a retaining ring.

In the following, the reasons for limitation of the composition of the corrosion-resistant non-magnetic steel according to the present invention are described.

Carbon (C): Carbon functions to stabilize the austenitic structure and also improve the strength, but an excessive amount of carbon may impair general corrosion resistance, pitting corrosion resistance, crevice corrosion resistance, SCC resistance and toughness. For this reason, the upper limit is 0.4%. Further, from the standpoint of corrosion resistance and strength, the content of carbon is desired to be from 0.17 or more to 0.3% or less.

Nitrogen (N): Nitrogen is a particularly important element, which is required to be added in an amount exceeding 0.3% for improvement of pitting corrosion resistance and SCC resistance simultaneously with stabilization of the austenitic structure and improvement of the strength. However, since an excessive amount of nitrogen added may impair toughness and also a high pressure is necessary for addition of nitrogen, the upper limit is 1%, but its content is desirably 0.4 to 0.8% in view of generation of micropores.

Silicon (Si): Silicon acts as a deoxidizer in molten steel and also improves castability of molten steel, but an excessive addition of silicon may impair toughness of the steel. Thus, the upper limit is determined as 2%. Preferably, an amount of silicon to be added is 1.5% by weight or less.

Chromium (Cr): Chromium, which functions to decrease the contents of carbon, nitrogen and manganese necessary for obtaining non-magnetic characteristics and which also improves general corrosion resistance and crevice corrosion resistance, is required to be added in an amount of 12% or more, but the upper limit is 20%, since an excessive addition of chromium may reduce the non-magnetic characteristics due to the formation of ferrite. In order to have both nonmagnetic characteristics and crevice corrosion resistance exhibited to the full content, chromium is added desirably in an amount of 13 to 18%, more desirably 15 to 17% by weight.

Manganese (Mn): Manganese is required to be added in an amount of 13% or more in order to stabilize the austenitic structure and improve strength, work hardening characteristic and crevice corrosion resistance, but the upper limit is made 25% in view of the fact that an excessive addition thereof may impair workability. In consideration of strength, non-magnetic characteristics, corrosion resistance and work hardening characteristic, an amount of manganese to be added is preferably from 15 to 24%, more preferably from 17 to 20%.

Molybdenum (Mo): Molybdenum functions to improve pitting corrosion resistance, but its upper limit is made 5% in view of the fact that its excessive addition may impair toughness of the steel. Preferably, an amount of molybdenum to be added is from 1.0% or more to 2.5% by weight or less.

Within the above composition range, the total content of manganese and chromium is required to be 30% or more, since a total content of manganese and chromium less than 30% can give only a low crevice corrosion resistance. Preferably, the total amount of them is not less than 32% by weight.

The corrosion-resistant non-magnetic steel of the present invention may be manufactured in accordance with, for example, the following procedure:

With the aid of a common melting furnace such as an electroarc furnace, a consumed electrode type arc furnace, a high-frequency induction furnace, an electroslug furnace or a resistance furnace, pieces of steel are molten and cast in vacuum or in a nitrogen gas atmosphere. In this case, the addition of nitrogen can be carried out by utilizing a mother alloy such as Fe—Cr—N or Cr—N, by feeding nitrogen gas or by using together both of them.

The thus obtained high manganese non-magnetic steel of the present invention has excellent general corrosion resistance, pitting corrosion resistance, crevice corrosion resistance and SCC resistance and is not deteriorated in non-magnetic characteristics even by a cold working without any formation of strain-induced martensite. Therefore, it is useful as non-magnetic steels for which corrosion resistance and high strength are required, in uses such as parts for generator, structural parts for nuclear fusion furnace and parts for ship, which are to be used under corrosive environments.

Further, in regard to the retaining ring for a generator made of a corrosion-resistant non-magnetic steel which is provided by the present invention as an illustrative application of the corrosion-resistant non-magnetic steel, explanation will be made in reference to the accompanying drawings, in the following:

As shown in the partial sectional view of FIG. 1, in a generator a rotor shaft (1) has a coil end turn (2) and a supporting ring (3) arranged in the vicinity of an end portion thereof, and a retaining ring (4) is disposed on the periphery of the supporting ring (3). Further, the reference numeral (5) in FIG. 1 represents a central opening in the rotor shaft (1).

If the above-mentioned corrosion-resistant nonmagnetic steel of the present invention is employed as a material for the retaining ring, the obtained retaining ring for a generator will have excellent general corrosion resistance, pitting corrosion resistance, crevice corrosion resistance and SCC resistance and have also excellent characteristics such as non-magnetic characteristics retained without any formation of strain-induced martensite by a cold working.

The retaining ring for a generator of the present invention may be manufactured according to, for example, the following procedure:

A cast ingot is subjected to a hot forging treatment at a temperature of 900° to 1200° C. and then formed into a ring shape, followed by a solution treatment at a temperature of 900° to 1200° C. and quenched in water. After water quench, if desired, the ring is preheated at a temperature of 300° to 400° C., and is expanded by an expanding method such as a segment method. Subsequently, an annealing treatment is done at a temperature of 300° to 400° C. in order to remove stress.

The corrosion-resistant non-magnetic steel and a retaining ring for a generator made of it according to the present invention is described below by referring to the following Examples and Comparative examples.

EXAMPLES 1 TO 11 AND COMPARATIVE EXAMPLES 1 TO 21

By means of a high frequency induction furnace, 32 kinds of non-magnetic steels having the compositions as shown in Table 1 were prepared. In Examples 1 to 11 and Comparative examples 13 to 21, nitrogen was added thereto under a nitrogen pressure controlled to 3 to 10 atm. Then, hot forging was effected at 1200° to 900° C., and the steels were subjected to a solution treatment at 1100° C. for 2 hours and followed by water quench. Thereafter, a uni-axial cold working was performed until the true stress was 130 kg/mm$^2$, followed by stress relief annealing at 350° C. for 2 hours, and the plate material was then cut out.

The corrosion test was performed by dipping the test pieces in a 3% NaCl simulated sea water for 30 days, and the number of pits formed and the maximum depth of pit were measured by visual observation and optical method respectively. The number of pits is represented by the total pits generated in an area of 160 mm$^2$. The crevice corrosion test was conducted using a test piece contacted with a glass rod of 3 mm in diameter; the test piece was dipped in the 3% NaCl simulated sea water for 30 days, and the depth of crevice was measured. The SCC test was performed by the 3-point bending test method in a 3% NaCl simulated sea water under the maximum stress of 50 kg/mm$^2$, and the presence of inter-crystalline cracking was examined. The magnetic characteristics were evaluated by measuring the specific permeability when subjected to a cold working up to a true stress of 130 kg/mm$^2$ by means of a permeameter. The results are listed in Table 2 to sum up.

TABLE 1

| | C | N | Si | Cr | Mn | Mo | Fe |
|---|---|---|---|---|---|---|---|
| Example 1 | 0.11 | 0.57 | 0.38 | 13.19 | 19.50 | — | Bal |
| Example 2 | 0.11 | 0.55 | 0.40 | 13.03 | 24.17 | — | " |
| Example 3 | 0.10 | 0.53 | 0.44 | 15.12 | 17.26 | — | " |
| Example 4 | 0.20 | 0.49 | 0.42 | 15.08 | 17.30 | — | " |
| Example 5 | 0.10 | 0.61 | 0.42 | 15.09 | 20.83 | — | " |
| Example 6 | 0.12 | 0.63 | 0.43 | 15.25 | 23.94 | — | " |
| Example 7 | 0.11 | 0.51 | 0.44 | 16.90 | 13.22 | — | " |
| Example 8 | 0.11 | 0.60 | 0.44 | 17.12 | 16.89 | — | " |
| Example 9 | 0.11 | 0.66 | 0.46 | 17.08 | 20.91 | — | " |
| Example 10 | 0.10 | 0.65 | 0.44 | 16.97 | 24.12 | — | " |
| Example 11 | 0.20 | 0.51 | 0.43 | 15.21 | 17.15 | 2.03 | " |
| Comparative example 1 | 0.52 | 0.12 | 0.51 | 5.11 | 17.83 | — | " |
| Comparative example 2 | 0.50 | 0.12 | 0.49 | 6.98 | 23.71 | — | " |
| Comparative example 3 | 0.48 | 0.13 | 0.53 | 9.04 | 13.01 | — | " |
| Comparative example 4 | 0.52 | 0.11 | 0.50 | 11.07 | 13.18 | — | " |
| Comparative example 5 | 0.50 | 0.10 | 0.50 | 11.23 | 16.24 | — | " |
| Comparative example 6 | 0.52 | 0.10 | 0.51 | 11.14 | 20.55 | — | " |
| Comparative example 7 | 0.51 | 0.12 | 0.51 | 13.15 | 12.90 | — | " |
| Comparative example 8 | 0.51 | 0.10 | 0.52 | 13.04 | 16.21 | — | " |
| Comparative example 9 | 0.49 | 0.11 | 0.46 | 13.07 | 19.86 | — | " |
| Comparative example 10 | 0.49 | 0.11 | 0.48 | 15.15 | 16.17 | — | " |
| Comparative example 11 | 0.53 | 0.10 | 0.48 | 16.97 | 15.92 | — | " |
| Comparative example 12 | 0.51 | 0.13 | 0.52 | 17.06 | 24.41 | — | " |
| Comparative example 13 | 0.10 | 0.38 | 0.47 | 5.04 | 13.21 | — | " |
| Comparative example 14 | 0.20 | 0.45 | 0.45 | 9.04 | 12.25 | — | " |
| Comparative example 15 | 0.11 | 0.49 | 0.43 | 9.09 | 15.79 | — | " |
| Comparative example 16 | 0.10 | 0.47 | 0.44 | 9.21 | 20.14 | — | " |
| Comparative example 17 | 0.12 | 0.44 | 0.43 | 9.05 | 23.89 | — | " |
| Comparative example 18 | 0.11 | 0.46 | 0.45 | 11.22 | 16.92 | — | " |
| Comparative example 19 | 0.10 | 0.50 | 0.45 | 11.17 | 24.08 | — | " |
| Comparative example 20 | 0.10 | 0.56 | 0.44 | 13.24 | 13.50 | — | " |
| Comparative example 21 | 0.10 | 0.49 | 0.45 | 13.00 | 16.31 | — | " |

TABLE 2

| | Presence of general corrosion | Presence of SCC | Number of pit | Maximum depth of pit (mm) | Depth of crevice (mm) | Permeability |
|---|---|---|---|---|---|---|
| Example 1 | None | None | 0 | 0 | 0 | less than 1.1 |
| Example 2 | " | " | 0 | 0 | 0 | " |
| Example 3 | " | " | 1 | 0.05 or less | 0 | " |
| Example 4 | " | " | 0 | 0 | 0 | " |
| Example 5 | " | " | 0 | 0 | 0 | " |
| Example 6 | " | " | 0 | 0 | 0 | " |
| Example 7 | " | " | 0 | 0 | 0 | " |
| Example 8 | " | " | 0 | 0 | 0 | " |
| Example 9 | " | " | 0 | 0 | 0 | " |
| Example 10 | " | " | 0 | 0 | 0 | " |
| Example 11 | " | " | 0 | 0 | 0 | " |
| Comparative example 1 | Present | Present | — | — | 0.17 | less than 1.1 |
| Comparative example 2 | " | None | — | — | 0.20 | " |
| Comparative | None | " | 1 | 0.12 | 0.61 | 1.1 or more |

TABLE 2-continued

| | Presence of general corrosion | Presence of SCC | Number of pit | Maximum depth of pit (mm) | Depth of crevice (mm) | Permeability |
|---|---|---|---|---|---|---|
| example 3 | | | | | | |
| Comparative example 4 | " | Present | 1 | 0.72 | 0.72 | " |
| Comparative example 5 | " | None | 2 | 0.56 | 0 | less than 1.1 |
| Comparative example 6 | " | " | 2 | 0.11 | 0.86 | " |
| Comparative example 7 | " | " | 4 | 0.81 | 0.37 | " |
| Comparative example 8 | " | Present | 5 | 0.99 | 0 | " |
| Comparative example 9 | " | " | 3 | 0.97 | 0 | " |
| Comparative example 10 | " | " | 7 | 0.96 | 0 | " |
| Comparative example 11 | " | None | 8 | 0.70 | 0 | " |
| Comparative example 12 | Present | Present | 5 | 0.12 | 0 | " |
| Comparative example 13 | " | None | — | — | 0.55 | 1.1 or more |
| Comparative example 14 | None | " | 0 | 0 | 0.74 | " |
| Comparative example 15 | " | " | 0 | 0 | 0.23 | " |
| Comparative example 16 | " | " | 0 | 0 | 0.35 | " |
| Comparative example 17 | " | " | 0 | 0 | 0.28 | less than 1.1 |
| Comparative example 18 | " | " | 0 | 0 | 0.50 | " |
| Comparative example 19 | " | " | 0 | 0 | 0.19 | " |
| Comparative example 20 | " | " | 0 | 0 | 0.39 | " |
| Comparative example 21 | " | " | 0 | 0 | 0.77 | " |

As apparently seen from Table 2, no conventional high manganese non-magnetic steels of Comparative examples 1 to 12 has all of general corrosion resistance, pitting corrosion resistance, crevice corrosion resistance and SCC resistance. In Comparative examples 13 to 21 in which nitrogen contents are enhanced, pitting corrosion resistance and SCC resistance are particularly improved, but they are inferior in crevice corrosion resistance.

The non-magnetic steels of Examples 1 to 11 according to the present invention are excellent in general corrosion resistance, pitting corrosion resistance, crevice corrosion resistance and SCC resistance, and the magnetic characteristics are not different from those of conventional materials. Thus, they can be said to be high strength non-magnetic steels excellent in corrosion resistance.

EXAMPLES 12 TO 21 AND COMPARATIVE EXAMPLES 22 TO 32

By means of a high frequency induction furnace, 21 kinds of non-magnetic steels having the compositions as shown in Table 3 were prepared. In Examples 12 to 21 and Comparative examples 22 to 32, nitrogen was added thereto under a nitrogen pressure controlled to 3 to 10 atm. Then, hot forging was effected at 1200° to 900° C. and the steels were subjected to a solution treatment at 1100° C. for 2 hours and followed by water quench. Thereafter, a cold working was performed until the true stress was 130 kg/mm$^2$ to prepare a base material for retaining ring model, followed by stress relief annealing at 350° C. for 2 hours, and the plate material for the tests was then cut out from the base material for retaining ring model.

The corrosion test was performed by dipping the test pieces in a 3% NaCl simulated sea water for 30 days, and the number of pits formed and the maximum depth of pit were measured by visual observation and optical method respectively. The number of pits is represented by the total pits generated in an area of 160 mm$^2$. The crevice corrosion test was conducted using a test piece contacted with a glass rod of 3 mm in diameter; the test piece was dipped in the 3% NaCl simulated sea water for 30 days, and the depth of crevice was measured. The SCC test was performed by the 3-point bending test method in a 3% NaCl simulated sea water under the maximum stress of 50 kg/mm$^2$, and the presence of cracking was examined. The magnetic characteristics were evaluated by measuring the specific permeability when subjected to a cold working up to a true stress of 130 kg/mm$^2$ by means of a permeameter. The results are listed in Table 4 to sum up.

TABLE 3

| | C | N | Si | Cr | Mn | Mo | Fe |
|---|---|---|---|---|---|---|---|
| Example 12 | 0.10 | 0.52 | 0.40 | 13.9 | 18.2 | — | Bal |
| Example 13 | 0.11 | 0.60 | 0.40 | 12.9 | 20.3 | — | " |
| Example 14 | 0.11 | 0.57 | 0.39 | 13.0 | 23.6 | — | " |
| Example 15 | 0.10 | 0.64 | 0.41 | 15.2 | 16.0 | — | " |
| Example 16 | 0.12 | 0.61 | 0.41 | 15.8 | 20.4 | — | " |
| Example 17 | 0.11 | 0.47 | 0.40 | 15.9 | 23.7 | — | " |
| Example 18 | 0.10 | 0.55 | 0.42 | 18.3 | 13.9 | — | " |
| Example 19 | 0.10 | 0.51 | 0.40 | 12.9 | 17.9 | — | " |
| Example 20 | 0.19 | 0.48 | 0.41 | 14.8 | 16.1 | — | " |
| Example 21 | 0.21 | 0.62 | 0.38 | 15.2 | 16.5 | 2.13 | " |
| Comparative | 0.53 | 0.12 | 0.42 | 5.0 | 18.1 | — | " |

TABLE 3-continued

| | C | N | Si | Cr | Mn | Mo | Fe |
|---|---|---|---|---|---|---|---|
| example 22 | | | | | | | |
| Comparative example 23 | 0.51 | 0.13 | 0.43 | 17.5 | 17.0 | — | " |
| Comparative example 24 | 0.11 | 0.48 | 0.40 | 6.8 | 13.1 | — | " |
| Comparative example 25 | 0.11 | 0.45 | 0.41 | 7.2 | 24.5 | — | " |
| Comparative example 26 | 0.10 | 0.50 | 0.41 | 9.3 | 14.9 | — | " |
| Comparative example 27 | 0.11 | 0.49 | 0.45 | 8.6 | 20.4 | — | " |
| Comparative example 28 | 0.10 | 0.53 | 0.43 | 11.0 | 19.8 | — | " |
| Comparative example 29 | 0.10 | 0.49 | 0.42 | 10.9 | 23.7 | — | " |
| Comparative example 30 | 0.10 | 0.51 | 0.40 | 11.8 | 12.7 | — | " |
| Comparative example 31 | 0.11 | 0.55 | 0.43 | 11.9 | 16.0 | — | " |
| Comparative example 32 | 0.12 | 0.47 | 0:45 | 15.8 | 11.9 | — | " |

TABLE 4

| | Presence of general corrosion | Presence of SCC | Number of pit | Maximum depth of pit (mm) | Depth of crevice (mm) | Permeability |
|---|---|---|---|---|---|---|
| Example 12 | None | None | 0 | 0 | 0 | less than 1.1 |
| Example 13 | " | " | 0 | 0 | 0 | " |
| Example 14 | " | " | 0 | 0 | 0 | " |
| Example 15 | " | " | 0 | 0 | 0 | " |
| Example 16 | " | " | 0 | 0 | 0 | " |
| Example 17 | " | " | 0 | 0 | 0 | " |
| Example 18 | " | " | 0 | 0 | 0 | " |
| Example 19 | " | " | 0 | 0 | 0 | " |
| Example 20 | " | " | 1 | 0.05 or less | 0 | " |
| Example 21 | " | " | 0 | 0 | 0 | " |
| Comparative example 22 | Present | Present | — | — | 0.21 | " |
| Comparative example 23 | None | None | 6 | 0.58 | 0 | " |
| Comparative example 24 | Present | " | — | — | 0.57 | 1.1 or more |
| Comparative example 25 | None | " | 0 | 0 | 0.33 | less than 1.1 |
| Comparative example 26 | " | " | 0 | 0 | 0.19 | 1.1 or more |
| Comparative example 27 | " | " | 0 | 0 | 0.40 | less than 1.1 |
| Comparative example 28 | " | " | 0 | 0 | 0.31 | " |
| Comparative example 29 | " | " | 0 | 0 | 0.26 | " |
| Comparative example 30 | " | " | 0 | 0 | 0.80 | 1.1 or more |
| Comparative example 31 | " | " | 0 | 0 | 0.51 | less than 1.1 |
| Comparative example 32 | " | " | 0 | 0 | 0.32 | " |

As apparently seen from Table 4, no conventional high manganese non-magnetic steels of Comparative examples 22 to 23 has all of general corrosion resistance, pitting corrosion resistance, crevice corrosion resistance and SCC resistance. In Comparative examples 24 to 32 in which nitrogen contents are enhanced, pitting corrosion resistance and SCC resistance are particularly improved, but they are inferior in crevice corrosion resistance due to small contents of chromium and manganese and therefore not suitable for a high strength retaining ring for a generator. The products of Examples 12 to 21 according to the present invention are excellent in general corrosion resistance, pitting corrosion resistance, crevice corrosion resistance and SCC resistance, and the magnetic characteristics are not different from those of conventional materials. Thus, it can be seen that they can be sufficiently suitable for use as retaining rings for a generator.

As described above, the retaining ring for a generator of the present invention has very excellent general corrosion resistance, pitting corrosion resistance, crevice corrosion resistance and SCC resistance and therefore it can be commercially very useful.

We claim:

1. A non-magnetic, crevice corrosion resistant steel retaining ring for a generator consisting essentially of, in terms of weight percentage, 0.4% or less of carbon, above 0.3% but up to 1% of nitrogen, 2% or less of silicon, 12 to 20% of chromium, 13 to 25% of manganese, the balance consisting substantially of iron, the total content of the chromium and manganese being at least 30%, said retaining ring manufactured by cold working and having a magnetic permeability less than 1.1.

2. A retaining ring for a generator according to claim 1, wherein said retaining ring further comprises 5% by weight or less of molybdenum.

3. A retaining ring for a generator according to claim 1, wherein said corrosion-resistant non-magnetic steel comprises, in terms of weight percentage, 0.3% or less of carbon, 0.4 to 0.8% of nitrogen, 1.5% or less of silicon, 13 to 18% of chromium, 15 to 24% of manganese and the balance consisting substantially of iron, the total content of the chromium and manganese being at least 32%.

4. A retaining ring for a generator according to claim 3, wherein the content of said molybdenum is 1.0 to 2.5% by weight.

5. A retaining ring for a generator according to claim 2, wherein said corrosion-resistant non-magnetic steel comprises, in terms of weight percentage, 0.3% or less of carbon, 0.4 to 0.8% of nitrogen, 1.5% or less of silicon, 13 to 18% of chromium, 15 to 24% of manganese and the balance consisting substantially of iron, the total content of the chromium and manganese being at least 32%.

6. A retaining ring for a generator according to claim 5, wherein the content of said molybdenum is 1.0 to 2.5% by weight.

* * * * *